US006310295B1

(12) United States Patent
Despard

(10) Patent No.: US 6,310,295 B1
(45) Date of Patent: Oct. 30, 2001

(54) LOW-CROSSTALK DATA CABLE AND METHOD OF MANUFACTURING

(75) Inventor: V. Boyd Despard, Lancaster, PA (US)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/453,531

(22) Filed: Dec. 3, 1999

(51) Int. Cl.[7] ..... H01B 11/02
(52) U.S. Cl. ..... 174/113 R; 174/113 C
(58) Field of Search ..... 174/36, 117 F, 174/117 FF, 110 R, 113 R, 113 C

(56) References Cited

U.S. PATENT DOCUMENTS

| | | | | |
|---|---|---|---|---|
| Re. 31,277 | * | 6/1983 | Gabriel et al. | 174/36 |
| 1,780,533 | * | 11/1930 | Oxer | 174/110 |
| 1,780,564 | * | 11/1930 | Oxer | 174/110 |
| 2,432,603 | * | 12/1947 | Zink | 174/110 |
| 3,848,073 | * | 11/1974 | Simons et al. | 174/36 |
| 3,911,200 | | 10/1975 | Simons et al. | 174/36 |
| 4,085,284 | * | 4/1978 | Olszewski et al. | 174/36 |
| 4,453,031 | * | 6/1984 | Justiss | 174/36 |
| 5,541,361 | * | 7/1996 | Friesen et al. | 174/34 |
| 5,789,711 | * | 8/1998 | Gaeris et al. | 174/113 C |
| 5,843,699 | * | 11/1998 | Buck et al. | 174/113 R |
| 5,952,615 | * | 9/1999 | Prudhon | 174/113 C |
| 6,248,954 | * | 6/2001 | Clark et al. | 174/113 C |

* cited by examiner

*Primary Examiner*—Dean A. Reichard
*Assistant Examiner*—William H Mayo, III
(74) *Attorney, Agent, or Firm*—Sughrue, Mion, Zinn, Macpeak & Seas, PLLC

(57) ABSTRACT

A low-crosstalk data cable and method of manufacturing the same, where a low-crosstalk data cable includes a cable housing jacket made of flexible insulating material for housing a multi-channel shielding member and a plurality of conductors. A hollow multi-channel shielding member of the invention is formed during the cable pulling process from a single, flat, thin, self-adapting shielding tape. The multi-channel shielding member separates and prevents crosstalk between adjacent conductors. A grounded low-crosstalk data cable is provided when a current drain wire is positioned down the center of the hollow multi-channel shielding member. Further, the low-crosstalk data cable may have a metallic outer shielding jacket positioned between the cable housing jacket and the combined conductor/multi-channel shielding member core. A second current drain wire may also be provided to enable grounding of the metallic outer shielding jacket.

14 Claims, 7 Drawing Sheets

LOW-CROSSTALK DATA CABLE AND METHOD OF MANUFACTURING

FIELD OF THE INVENTION

This invention relates generally to a multi-conductor cable and method of manufacturing the same. In particular, the invention is directed to a data cable with a shielding member to separate conductors of a cable where the shielding member prevents cross-talk between the conductors.

BACKGROUND OF THE INVENTION

Multi-conductor cables are common for transferring multiple currents to and from electronic systems and devices. For example, multi-conductor cables are frequently used for audio, video and data transmission between components in communication networks, computer systems, and other similar bi-directional data transmission systems. In these types of multi-conductor cables, it is essential to reduce or prevent cross-talk due to the electromagnetic fields of current flowing in adjacent conductors. It is also important to properly insulate the conductors from each other and to provide an overall cable that is flexible, lightweight and free of moisture. Due to the potential length of this type of multi-conductor cable, it is desirable to produce a high quality cable which is easily manufactured at a low cost.

DESCRIPTION OF RELATIVE ART

It is well known in the art to provide floating or grounded metallic shielding in multi-conductor cables to prevent cross-talk between adjacent conductors or conductor pairs in a cable. For example, U.S. Pat. No. 3,911,200 discloses a cable assembly having an encapsulated shielding tape made of a laminate metal foil and plastic film bonded together. This shielding tape is folded into an L- shape to form a channel and then laminated to another piece of similarly shaped shielding tape to result in a multi-channel shielding tape, wherein a conductor resides in each channel. Furthermore, International Patent WO 98/48430 discloses a shielding core formed of a cross-talk reducing conductive material. The core is formed of conductive material and has multiple fins extruding in an outward direction from the core in order to isolate conductors in respective channels.

These prior art shielding techniques have problems in that they require complex pre-assembly or intricate formation of shielding members prior to cable construction. Therefore, it is desired to have a self adapting shielding member that can be formed at the same time the cable is pulled together in a cabling production device.

SUMMARY OF THE INVENTION

Accordingly, it is an object of the present invention to provide a low cost, low-crosstalk data cable that is easily manufactured using a self-adapting shielding tape. It is a further object of the invention to provide a method of manufacturing a low-crosstalk data cable that eliminates the need and expense of pre-formed or complicated formation of a shielding member by forming a channeled shielding member during the cable pulling process.

Therefore, there is provided a low-crosstalk data cable having a cable housing jacket made of flexible insulating material for housing a multi-channel shielding member and a plurality of conductors. A hollow multi-channel shielding member of the invention is formed during the cable pulling process from a single, flat, thin, self-adapting shielding tape. The multi-channel shielding member separates and prevents crosstalk between adjacent conductors. A grounded low-cross talk data cable is provided when a current drain wire is positioned down the center of the hollow multi-channel shielding member. Further, the low-crosstalk data cable may have a metallic outer shielding jacket positioned between the cable housing jacket and the combined conductors/multi-shielding member core. A second current drain wire may also be provided to enable grounding of the metallic outer shielding jacket.

These and other objects are achieved in accordance with a preferred embodiment of the invention as discussed below.

DETAILED DESCRIPTION OF THE DRAWINGS

Figure 1:
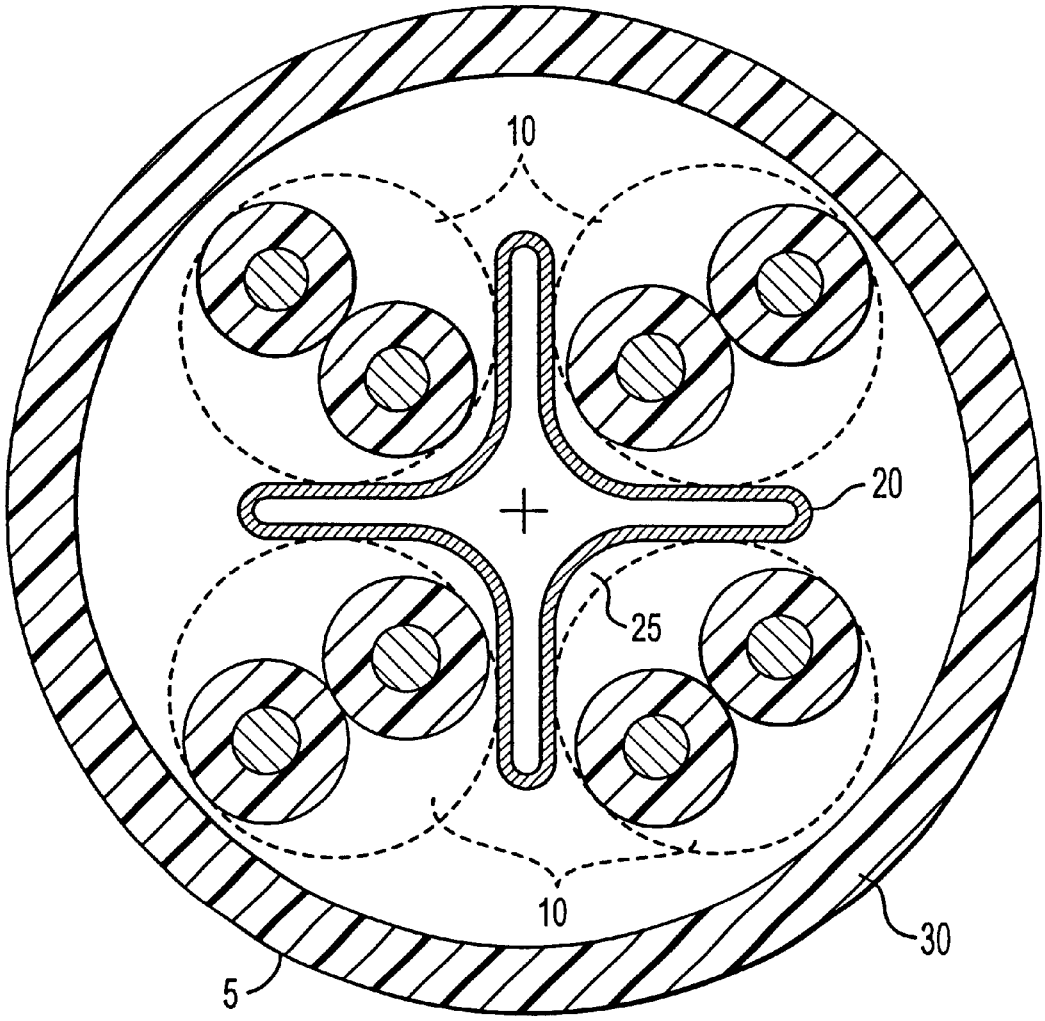
FIG. 1 illustrates a cross-sectional view of the low-crosstalk data cable according to a first preferred embodiment of the invention.

According to a preferred embodiment shown in FIG. 1, a low-crosstalk data cable 5 preferably includes four insulated conductor pairs 10 separated by a multi-channel shielding member 20. The multi-channel shielding member 20 is formed from a thin flat shielding tape which is folded into a tube and collapsed or indented to have a cross section resembling a plus-shape (see FIGS. 7*a*–7*c*). The conductor pairs 10 reside in the channels 25 of the multi-channel shielding member 20. It is preferable that the conductor pairs 10 are twisted in channels 25. The dashed lines represent the circumference of the twisted conductor pairs 10. The combination of the conductor pairs 10 and the multi-channel shielding member 20 is referred to as a "cable core". This cable core is then covered by a cable housing jacket 30 made of insulating flexible material such as rubber, plastic or polymer. The multi-channel shielding member 20 is typically made from a flexible conductive material such as aluminum.

As shown in FIG. 1, the multi-channel shielding member 20 has a substantially hollow center.

Figure 2A:
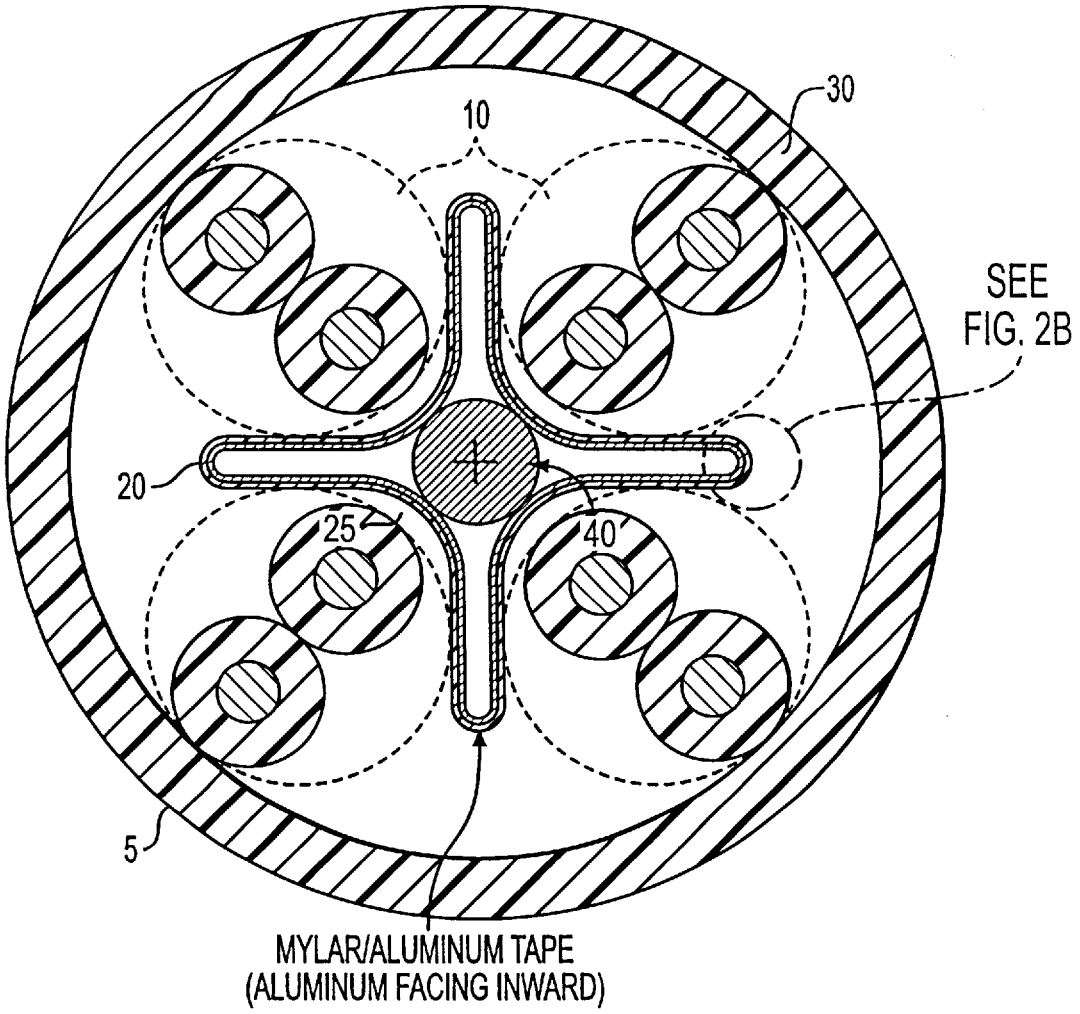
FIGS. 2(*a*) and (*b*) illustrate a cross-sectional view of a low-crosstalk data cable according to a second embodiment of the invention.

In a second embodiment of the invention, a grounded low-crosstalk data cable 5 is provided as shown in FIG. 2*a*. The second embodiment has the same structure of the first embodiment except that a shielding drain wire 40 resides in the substantially hollow center of the multi-channel shielding member 20. The shielding drain wire 40 provides a ground for currents that may accumulate in the multi-channel shielding member 20. The shielding drain wire 40 is made of a flexible conductive material such as copper.

Figure 2B:
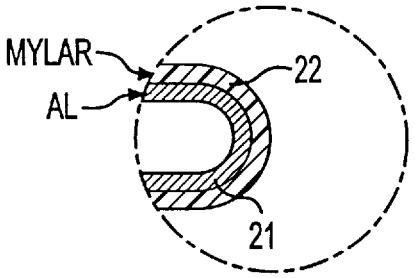

Additionally in this embodiment, as shown by the exploded view of FIG. 2*b*, the multi-channel shielding member 20 is made from an aluminum/mylar shielding tape. While the shielding tape for the multi-channel shielding member 20 can be made from numerous types of materials, the inventor has found that it is preferable that it be made from a shielding tape formed with two layers, an aluminum layer 21 and a mylar layer 22. The multi-channel shielding member 20 is then formed with the aluminum layer 21 on an interior surface of the multi-channel shielding member 20, and the mylar layer 22 outwardly facing the twisted pair conductors 10. The mylar layer 22 primarily serves as a bonding or strengthening material for the aluminum so that the aluminum does not tear or rip during cable fabrication (as discussed below).

However, the mylar layer 22 also serves as an additional insulator between the aluminum layer 21 and the conductor pairs 10. In fact, when the mylar layer 22 is thick enough, conductor wires located in channels 25 are not required to be independently insulated. Of course, with conductor pairs 10 independent insulation of conductor wires is essential.

Figure 3A:
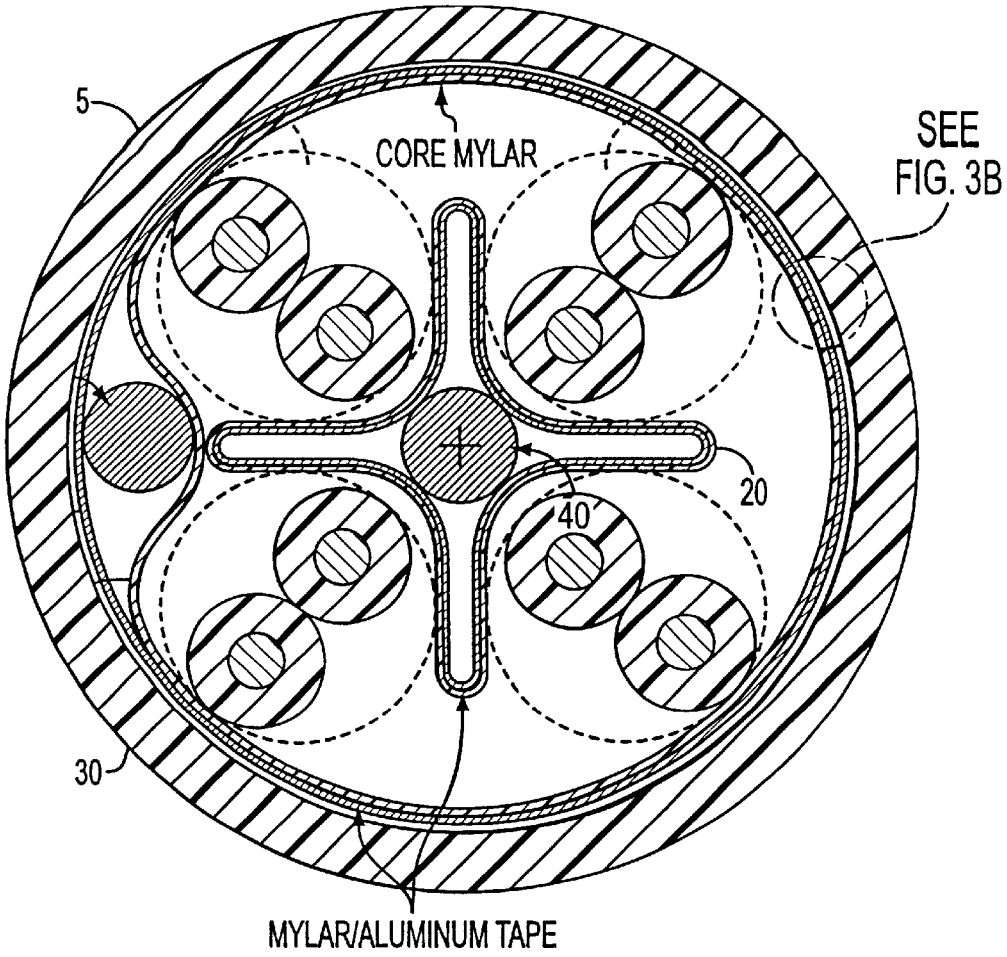
FIGS. 3(*a*) and (*b*) illustrate a cross-sectional view of a low-crosstalk data cable according to a third embodiment of the invention.
Figure 3B:
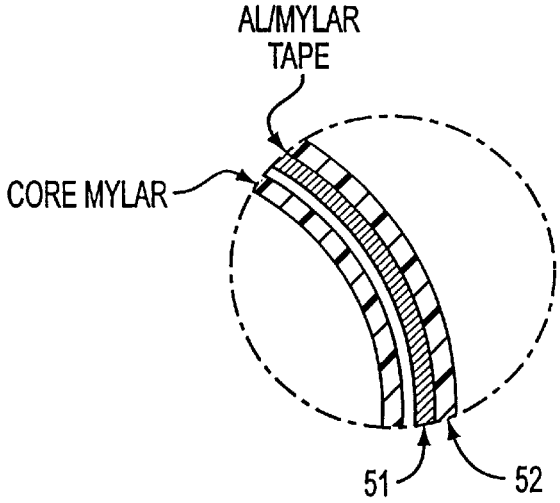

A third embodiment of the invention, as shown in FIGS. 3*a* and 3*b*, includes the grounded low-crosstalk data cable 5 of the second embodiment except that the cable core further includes an outer shielding jacket 50 which encapsulates the conductor pairs 10 and the multi-channel shielding member 20. The outer shielding jacket 50 provides additional shielding from electromagnetic fields that may be present from other sources such as adjacent cables.

In this embodiment, a second shielding drain wire 60 is provided to allow grounding of potential currents that accumulate in the outer shielding jacket 50. While the outer shielding jacket can be made from many different materials, it is preferable to provide a two-layer tape having a layer of aluminum 51 and a layer of mylar 52. The layer of mylar 52 provides additional strength for the aluminum layer 51 to avoid tearing during the fabrication process.

The aluminum/mylar outer shielding jacket 50 of the preferred embodiment is positioned such that the aluminum layer 51 is on an interior surface of the outer shielding jacket 50, while the mylar layer 52 faces outwardly toward the cable housing jacket 30. However, because of the potential for shorting between the outer shielding jacket 50 and the twisted pair conductors 10, it is also preferable to place a thin layer of mylar 53 between the twisted pair conductors 10 and the outer shielding jacket 50.

In the low-crosstalk data cable of the invention, four twisted pair conductors are discussed and shown. However, the multi-channel shielding member can be adapted for any number of conductors desired. Furthermore, it is not necessary that the conductors be insulated twisted pairs. The low-crosstalk data cable of the invention works equally as well with insulated or non-insulated single conductors.

Figure 4:
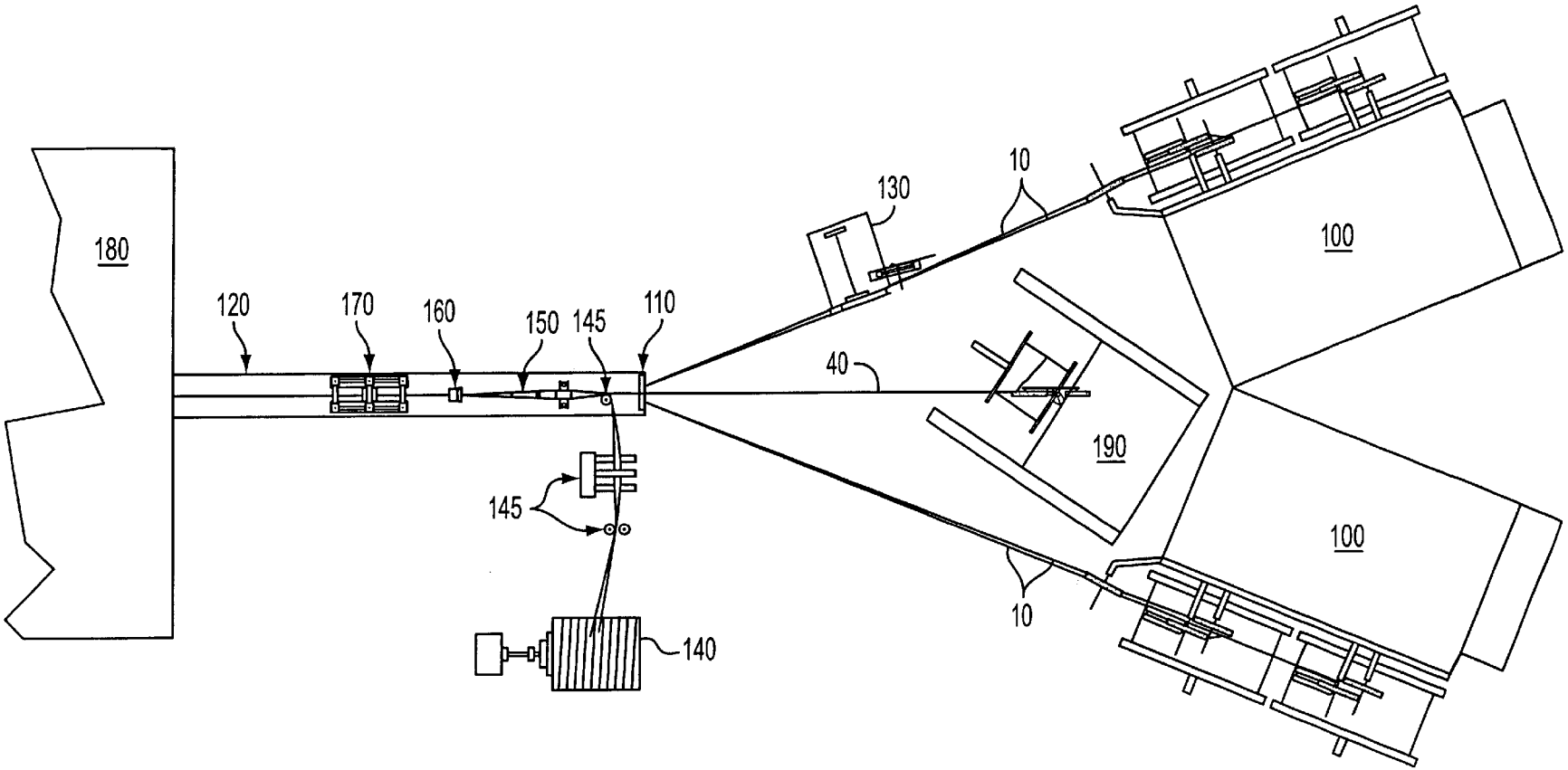
FIG. 4 illustrates a manufacturing setup and process for forming the low-crosstalk data cable of the invention.

A method of manufacturing the low-crosstalk data cable detailed above will now be described with reference to FIGS. 4–7. FIG. 4 shows the basic setup for manufacturing the low-crosstalk data cable. For simplicity, reference numerals are used that correspond to the cable components previously described. Here, a low-crosstalk data cable 5 is formed by pulling four twisted pair conductors 10 from two dual twisted pair payoffs 100. The dual twisted pair payoffs 100 are preferably self-driven. The four twisted pair conductors 10 are pulled through a series of box rollers 110 which are attached to a cable tool table 120. The box rollers 110 straighten and guide the twisted pair conductors as they are pulled from the dual twisted pair payoffs 100. A lay control 130, positioned between the dual twisted pair payoffs 100 and the box rollers 110, is used to control the lay length of the cable and count the cable footage.

Additionally, a thin, flat, self-adapting shielding tape is pulled from a tape let-off roll 140 through a series of horizontal and vertical tape rollers 145 into a tape folding tool 150 which is attached to the cable tool table 120. The tape folding tool 150 folds the shielding tape into a substantially tubular shape (see FIG. 7*b*, discussed in detail below). The tubular-shaped shielding tape is then fed through a "+"-shaped die 160 for collapsing or indenting the tubular shaped shielding tape into a "+"-like shape (see FIG. 7*c*), to form the multi-channel shielding member 20 and four twisted pair conductors 10 are combined through a 3-die setup 170 to form a cable core (FIG. 7*d*). The 3-die setup 170 guides each twisted pair conductor 10 into separate channels 25 of the multi-channel shielding member 20 and compresses them into a tight formation to form the cable core. The cable core is then fed into a cabler 180 where the cable core is tightly twisted. After the cabler 180, the resulting twisted cable core is processed through an extruder (not shown) for applying a polymer cable housing jacket 30. The cabler 180 and extruder (not shown) are well known in the industry and therefore have not been described in detail.

For the grounded shielded cable of the second embodiment, a shielding drain wire 40 is inserted into the center of the multi-channel shielding member 20. Here, a shielding drain wire 40 made of a flexible conductive material such as copper, is drawn from a drain wire pay-off 190. The shielding drain wire 40 is fed through the tape folding tool 150 and is surrounded by the shielding tape as it is bent into a tubular shape. The shielding drain wire 40 is secured in the center of the muli-channel shielding member 20 when the tubular-shaped shielding tape is collapsed by the "+"-shaped die 160.

To produce a low-crosstalk data cable according to the third embodiment, the same method is used as in the second embodiment, but an additional jacketing process is performed between the cabler 180 and the extruder (not shown). Here the cable core from the cabler 180 is run through a series of die (not shown) where the cable core is coated with a thin layer of mylar 53 and a second shielding drain wire 60 is strung along the cable core. The outer shielding jacket 50 is then applied through the series of die with an aluminum side facing inward toward the second shielding drain wire 60. The completed cable core is then run through the extruder to apply the cable housing jacket 30, as previously discussed.

Figure 5B:
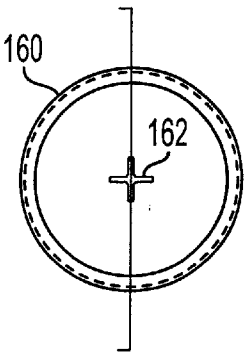
FIGS. 5*a*–5*d* illustrate the "+"-shaped die used to form the multi-channel shielding member for the low-crosstalk data cable of the preferred embodiment.
Figure 5D:
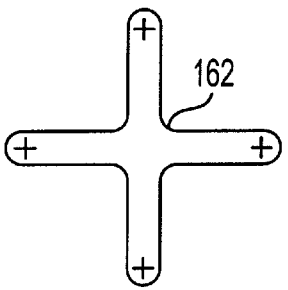
Figure 5A:
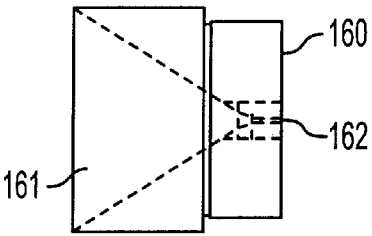
Figure 5C:
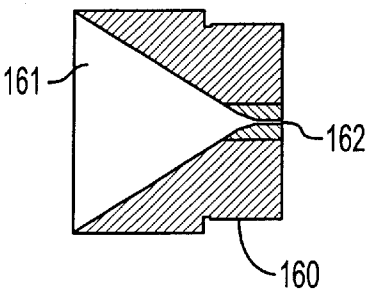

The "+"-shaped die 160, according to this manufacturing process, can be viewed in greater detail in FIGS. 5*a*–5*d*. FIG. 5*a* shows the "+"-shaped die 160 from a side view. FIG. 5*b* shows a rear view of the "+"-shaped die 160 where the multi-channel shielding member 20 exits. FIG. 5*c* shows a side view cross section of the die. As shown, the die has a funnel-shaped input 161 where the tubular-shaped shielding tape enters. The funnel-shaped input 161 collapses the tubular shielding tape and presses the shielding tape through a "+" shape exit hole 162 of the die detail shown in FIG. 5*d*, to form the multi-channel shielding member 20.

Figure 6A:
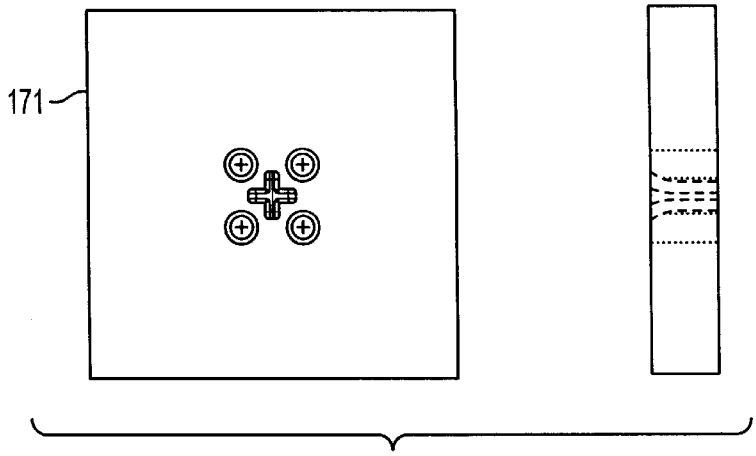
FIGS. 6*a*–6*c* illustrate individual die of a 3-die setup for forming a low-crosstalk data cable of the preferred embodiment.
Figure 6B:
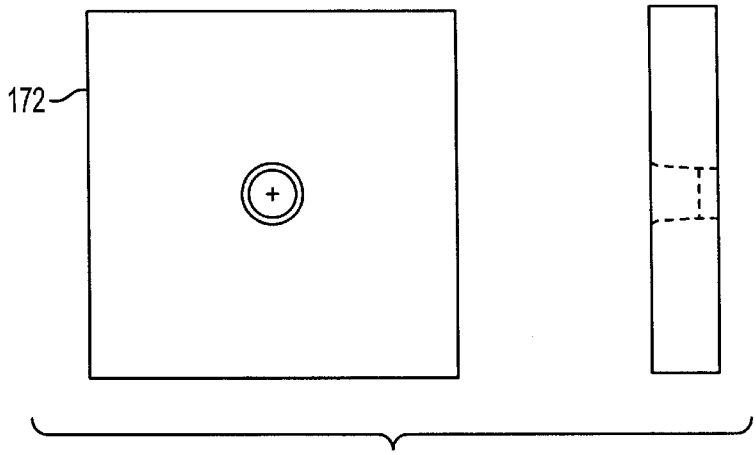
Figure 6C:
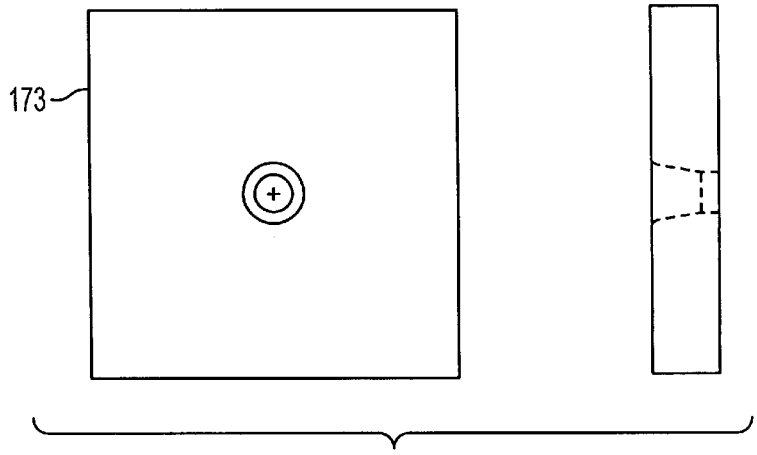

FIGS. 6*a*–6*c* show the respective dies in the 3-die setup 170. FIG. 6*a* shows a front and side view of a first die 171 that receives the multi-channel shielding member 20 and the four twisted pair conductors 10. This first die 171 aligns and guides the twisted pair conductors 10 into the channels 25 of the multi-channel shielding member 20. FIG. 6*b* illustrates the front and side views of a second closing die 172 which compresses the conductor pairs 10 and multi-channel shielding member 20 (cable core) into a circular diameter. FIG. 6*c* illustrates the front and side views of a third closing die 173 where the cable core is further compressed into a smaller diameter. The result of the 3-die setup is a cable core, which includes the conductor pairs 10 and the multi-channel shielding member 20, having a fixed diameter.

Figure 7A:
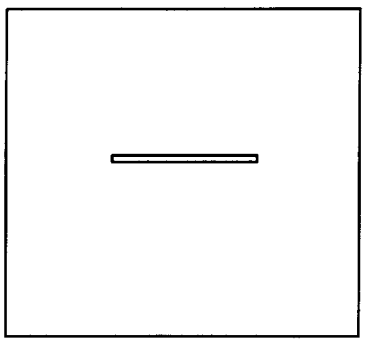
FIGS. 7*a*–7*d* illustrate the shape progression of forming a multi-channel shielding member and cable core of a low-crosstalk data cable of the preferred embodiment.
Figure 7B:
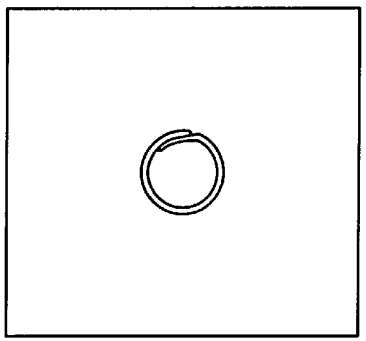
Figure 7C:
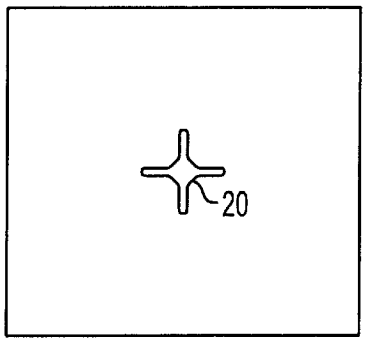
Figure 7D:
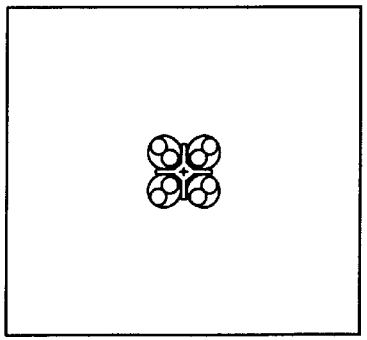

FIGS. 7*a*–7*d* illustrate the progression of the self-adapting shielding tape and cable core during the cable manufacturing process described above. FIG. 7*a* depicts the thin, flat, self-adapting shielding tape as it is received from the tape let off roll 140. FIG. 7*b* illustrates the tubular shape that results from the folding tool 150. FIG. 7*c* illustrates the "+" shape of the multi-channel shielding member 20 as it exits from the "+" plus-shape die 160. FIG. 7*d* illustrates the cable core of the first embodiment as it exits the first die 171 of the 3-die setup 170. As described and shown by the foregoing process, a high-quality low-crosstalk data cable according to objects of the invention is manufactured.

Although there have been described preferred embodiments of this novel invention, many variation and modifications are possible and the embodiments described herein are not limited by the specific disclosure above. In particular, the multi-channel shielding member 20 described herein, is not intended to be limited to only a cross-talk shielding device. For example, the multi-channel shielding member 20 can be used as an insulating member or for any other purpose requiring channels formed inside a cable.

What is claimed is:

1. A low-crosstalk data cable comprising:

a flexible cable housing jacket;

a self-adapting shielding member longitudinally disposed through said flexible cable housing jacket, said self adapting shielding member forming channels inside said flexible cable housing jacket; and a plurality of conductor wires longitudinally disposed through said flexible cable housing jacket and individually separated by said self-adapting shielding member;

wherein said self-adapting shielding member is a single shielding tape, and wherein said self-adapting shielding member has two overlapping lateral ends that form a substantially hollow center, and wherein longitudinal indentations reside in said shielding tape to form said channels.

2. The low-crosstalk data cable according to claim 1, wherein said self-adapting shielding member is a flexible, substantially metallic material and wherein said plurality of conductor wires are insulated twisted pair conductor wires.

3. A low-crosstalk data cable comprising:

a cable housing jacket made from a flexible insulating material;

a shielding tape longitudinally disposed through said cable housing jacket, said shielding tape having two overlapping lateral ends that form a substantially hollow center and said shielding tape having length-wise indentations which form a plurality of channels in said cable housing jacket; and a plurality of insulated twisted pair conductor wires longitudinally disposed through said cable housing jacket, such that each insulated twisted pair conductor wire is contained within an individual channel.

4. The low-crosstalk data cable according to claim 3, wherein four insulated twisted pair conductor wires are individually separated by said shielding tape in a substantially cross-shape, and wherein said shielding tape is made of a flexible, substantially aluminum material.

5. The low-crosstalk data cable according to claim 4, further comprising a shielding drain wire made of a flexible, conductive material, said shielding drain wire disposed longitudinally through said substantially hollow center of said shielding tape.

6. The low-crosstalk data cable according to claim 5, further comprising:

a metallic outer shielding jacket longitudinally disposed on an inner surface of said cable housing jacket, wherein said metallic outer shielding jacket encapsulates said four insulated twisted pair conductor wires and said shielding tape; and a second shielding drain wire made of flexible, conductive material, said second shielding drain wire longitudinally disposed between said metallic outer shielding jacket and said four insulated twisted pair conductor wires.

7. A method of manufacturing a low-cross-talk data cable comprising:

forming a multi-channel shielding member with a substantially hollow center from a single, flat, self-adapting shielding tape by overlapping two lateral ends of said shielding tape;

forming longitudinal indentations in said multi-channel shielding member to form channels;

forming a cable core by combining said multi-channel shielding member with a plurality of conductive wires, wherein said plurality of conductive wires are placed into said channels of said multi-channel shielding member; and encapsulating said cable core in a flexible insulating cable housing.

8. The method of manufacturing a low-crosstalk data cable according to claim 7, wherein forming said cable core further comprises coating the combined multi-channel shielding member and plurality of conductive wires with a substantially metallic outer shielding jacket.

9. The method of manufacturing a low-crosstalk data cable according to claim 8, wherein four twisted pair conductor wires are combined with said multi-channel shielding member, and wherein said multi-channel shielding member and said outer metallic shielding jacket are made from a flexible, substantially aluminum material.

10. A method of manufacturing a low-crosstalk data cable comprising:

pulling a plurality of conductor wires into a cable forming device, said conductor wires acquired from their respective payoff rolls;

pulling a flat-self-adapting shielding tape into a tapefolding tool of the cable forming device, said flat self-adapting shielding tape acquired from a tape let-off roll;

folding the flat self-adapting shielding tape into a substantially tubular-shaped shielding tape having a substantially hollow center via said tape folding tool by overlapping two lateral ends of said shielding tape;

pulling the tubular-shaped shielding tape through an indentation die to form a multi-channel shielding member having a plurality of longitudinal channels;

forming a cable core by combining the multi-channel shielding member with said plurality of conductor wires, wherein individual conductor wires are placed into separate longitudinal channels; and coating said cable core with a flexible insulating material.

11. The method of manufacturing a low-crosstalk data cable according to claim 10, wherein said multi-channel shielding member has four channels such that a cross-section of said channeled shielding member resembles a plus-shape, and wherein four insulated, twisted pair, conductor wires are placed into respective channels.

12. The method of manufacturing a low-crosstalk data cable according to claim 11, wherein forming said cable core further comprises inserting a shielding drain wire longitudinally through an interior of said multi-channel shielding member.

13. The method of manufacturing a low-crosstalk data cable according to claim 12, wherein forming said cable core further comprises encapsulating a second shielding drain wire and the combined multi-channel shielding member and conductor wires with a metallic outer shielding jacket.

14. A method of manufacturing a low-crosstalk data cable according to claim 13, wherein said flat self-adapting shielding tape and said metallic outer shielding jacket are made of flexible, substantially aluminum material.

* * * * *